United States Patent [19]

Gertsch

[11] 4,340,242

[45] Jul. 20, 1982

[54] SAFETY SKI BINDING

[75] Inventor: Ulrich E. Gertsch, Interlaken, Switzerland

[73] Assignee: Egs-Skisport Gesellschaft für Forschung und Entwicklung mbH, Munich, Fed. Rep. of Germany

[21] Appl. No.: 138,753

[22] Filed: Apr. 9, 1980

[30] Foreign Application Priority Data

Apr. 10, 1979 [CH] Switzerland ..... 3369/79

[51] Int. Cl.[3] ..... A63C 9/08

[52] U.S. Cl. ..... 280/618; 280/628

[58] Field of Search ..... 280/617, 618, 626, 628, 280/616

[56] References Cited

U.S. PATENT DOCUMENTS 4,052,086 10/1977 Eckart ..... 280/618

4,230,338 10/1980 Weigl et al. ..... 280/618

*Primary Examiner*—Joseph F. Peters, Jr.

*Assistant Examiner*—Michael Mar

*Attorney, Agent, or Firm*—Fleit & Jacobson

[57] ABSTRACT

The releasing plate which is carried for lateral pivotal motion by a pivot pin secured to the ski and which is releasably retained in its skiing position by releasing means is comprised of two members which are adapted to be relatively slidable in the direction of the longitudinal axis of the releasing plate. The rear plate member which is supported for pivotal movement by means of said pivot pin attached to the ski has its rear end provided with automatic heel holding means adapted to be released upon the skier falling in a forward direction, whereas the front plate member carries a ski boot sole holder. The front plate member is connected to a sliding member which is slidably guided in said rear plate member, said slide member being urged towards the front end of the ski by means of compression springs. Said front plate member is adapted to be pivoted upwardly under the influence of a coiled spring about a pivot axle extending at right angles to the longitudinal axis of said releasing plate as well as the ski. Should the releasing plate be released for lateral pivoting by said releasing means during a torsional fall of the skier, the front plate member is moved forwardly under the influence of said compression springs and is pivoted upwardly in the direction of arrow A in FIG. 1 by said coiled spring. After the ski boot has been detached from the releasing plate, the releasing plate is automatically restored to its skiing position by a spring which is adapted to be tensioned upon the releasing plate being pivoted in a lateral direction. The restoration of the releasing plate will not be impeded by the upwardly pivoted front plate member since this member extends above said releasing means.

13 Claims, 2 Drawing Figures

SAFETY SKI BINDING

FIELD OF THE INVENTION

This invention relates to a safety ski binding.

DESCRIPTION OF THE PRIOR ART

In a known safety ski binding of the type to which this invention relates, the sole holding means are attached to a plate which, after the releasing plate has been pivoted out of its normal position of use, is adapted, under the influence of a spring, to move towards to forward end of the ski, i.e. away from the heel holding means so as to release the ski boot (Federal German Laid-Open Specification No. 25 10 385). With said releasing plate in its skiing position, the sole holding means are retained in their normal position by a detent cam rigidly connected to the releasing plate, said detent cam being adapted to engage a stop member which is rigidly attached to the ski. After the ski boot has been detached from the releasing plate, a restoring mechanism serves to return the releasing plate into its skiing position. However, the releasing plate cannot be completely returned into its skiing position since said detent cam which moves together with the sole holding means is in lateral contact with said stop member. It would, of course, be possible to provide suitable means which are adapted to urge the sole holding means including said detent cam into its normal position upon said releasing plate being pivoted back so as to permit the detent cam again to engage the rear side of the stop member. However, the adoption of this solution would require complicated structure if satisfactory operation is to be ensured.

OBJECT OF THE INVENTION

It is a primary object of the present invention to provide a safety ski binding of the aforementioned type which is adapted, upon a lateral release motion occurring after the ski boot has been detached from the releasing plate, automatically and completely to restore the releasing plate into its skiing position in a simple and reliable manner.

SUMMARY OF THE INVENTION

This object is attained, according to the present invention, by the provision of a safety ski binding in which it is possible, by upwardly tilting the sole and heel holding means, respectively, to have the releasing plate to be restored into its skiing position by means of the restoring mechanism without it being possible for said holding means in their upwardly pivoted position to interfere with any component part such as the lateral releasing means rigidly attached to the ski, any interference with the backward tilting motion thus being excluded.

Since the holding means which are capable of being pivoted upwardly are preferably retained in their normal position by locking means which may, for example, be constituted by said lateral releasing means, such locking means may also be employed to release the ski boot in the case of rearward falls (with upwardly pivotable sole holding means) and in the case of a forward fall (with upwardly pivotable heel holding means).

Other objects and features of the invention will become apparent as the description proceeds, especially when taken in conjunction with the accompanying drawings illustrating a preferred embodiment of the invention, wherein:

DETAILED DESCRIPTION OF THE PREFERRED EMBODIMENT

Figure 1:
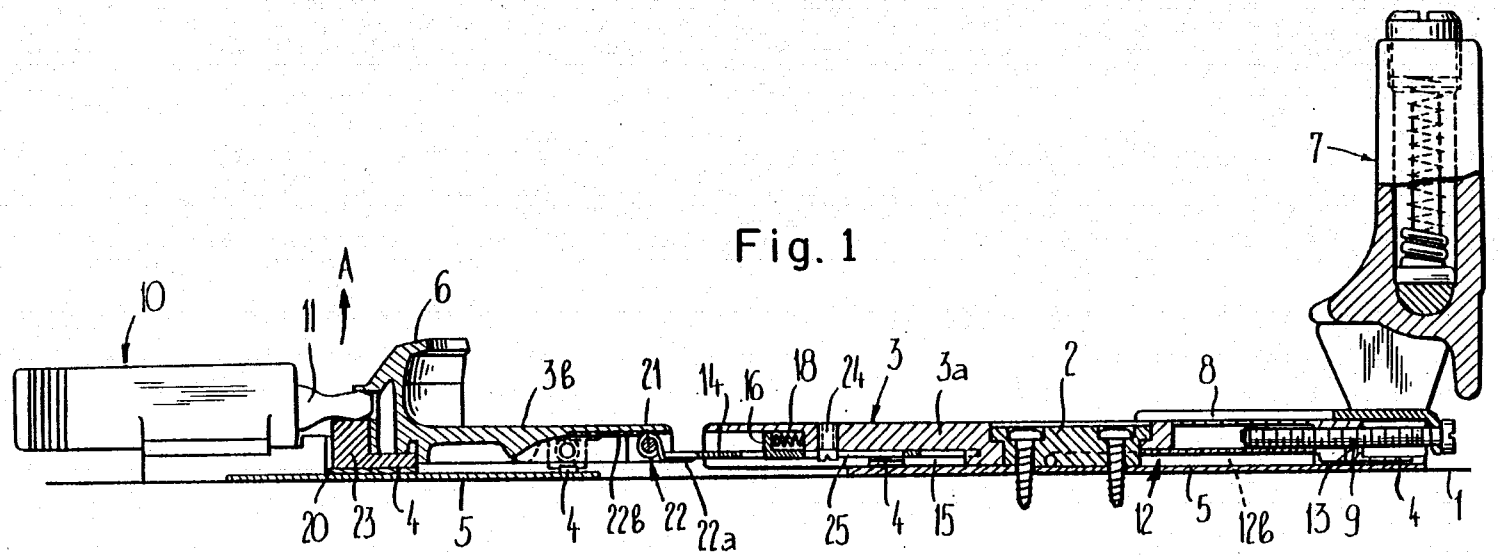
FIG. 1 shows an elevation, partly in longitudinal section, of a safety ski binding of the invention mounted on a ski.

As shown in the drawing, a releasing plate 3 is rotatably mounted on a ski 1 by means of a cylindrical pivot pin. The releasing plate 3 comprises two members 3*a* and 3*b* which are interconnected in a manner to be described. The pivot pin 2 which is secured to ski 1 by means of screws and which is provided with a radially projecting flange has its flange arranged to extend over part of plate member 3*a* to prevent retaining plate 3 from being lifted off ski 1 but permitting lateral pivoting of the retaining plate. On its under side retaining plate 3 is provided with anti-friction elements 4 which bear on small steel plates 5 attached to ski 1 in order to minimize the friction between retaining plate 3 and ski 1 upon the retaining plate being pivoted in a laterial direction. On its front end which points toward the front end of ski 1, the retaining plate 3 is provided with a sole holder 6 which is integrally connected with plate member 3*b* in the embodiment shown. On its rear end the releasing plate 3 carries an automatic heel retaining mechanism 7 of known construction, this mechanism being adapted to release the ski boot in a known manner during a forward fall of the skier. Said heel retaining mechanism 7 is mounted on a slide member 8 which is connected with plate member 3*a* such as to be movable longitudinally of the ski. An adjusting screw 9 enables slide member 8 together with heel retaining mechanism 7 to be adjusted in relation to releasing plate 3 so that the distance between sole holder 6 and heel retaining mechanism 7 can be selected to suit ski boots of different sizes. Mounted on slide member 8 is a ski brake (not shown) which is of known construction as described, for example, in Swiss application for patent No. 6858/78. Said ski brake comprises two braking arms which are disposed on opposite sides of ski 1. With the ski brake in its skiing position in which it is retained by the ski boot received by the binding, the two braking arms extend substantially parallel to the longitudinal axis of the ski. As soon as the ski boot is detached from releasing plate 3, with the releasing plate in its skiing position shown in FIGS. 1 and 2, the ski brake is moved into its braking position by a spring element; in this braking position the two braking arms extend downwardly beyond the sliding surface of the ski so as to prevent the ski from becoming lost. The fact that the ski brake is mounted on slide member 8 affords the advantage that the ski brake will always retain its position in relation to the heel of the ski boot even if slide member 8 is displaced. It will be understood, however, that it is also possible directly to attach the ski brake to releasing plate member 3*a*.

With its front end, releasing plate 3 cooperates with a lateral releasing mechanism 10 of known construction which is provided with a spring-urged releasing pin 11 engaging an aperture of sole holder 6. This lateral releasing mechanism 10, the structure and manner of operation of which corresponds to the disclosure of U.S. Pat. No. 3,489,424, retains releasing plate 3 in its skiing position. Upon the lateral releasing mechanism 10 being actuated during a torsional fall, it will release releasing plate 3 to permit it to be pivoted in a lateral direction. As explained below, the lateral release mechanism 10 will also be actuated during a backward fall of the skier. It will be understood that the lateral release mechanism may also be of a construction differing from that shown in the drawing, for example, as disclosed in Federal German Laid-Open Specification No. 26 03 959.

For the purpose of restoring releasing plate 3 into its skiing position after having been pivoted, there is provided a restoring mechanism which, in the embodiment shown, is constituted by a spring 12 comprising two legs 12*a* and 12*b*. Spring 12 is held in position at its one end in pivot pin 2, and its legs 12*a* and 12*b* are in engagement with a recess 13 with which plate member 3*a* is provided. Upon releasing plate 3 being pivoted, one of the two legs 12*a* and 12*b* will be tensioned depending on the direction of pivoting. After the ski boot has been detached from releasing plate 3, the tensioned legs of spring 12 will restore the releasing plate to its skiing position. Other forms of restoring mechanisms which may be employed in the place of spring 12 are disclosed, for example, in Swiss patent application No. 6858/78. The two members 3*a* and 3*b* of releasing plate 3 are connected together in such a manner as to be slidable in relation to one another in a longitudinal direction. For this purpose the front plate member 3*b* is provided with a sliding member 14 which is guided for sliding motion in a longitudinal direction in a recess 15 with which the rear plate member 3*a* is provided. Slide member 14 interconnects the two plate members 3*a* and 3*b* in such a manner that they are always pivoted together in a lateral direction. Sliding member 14 is provided with two upwardly extending tabs 16 and 17, each forming an abutment for one of two compression springs 18 and 19, the other ends of which bear on plate member 3*a*. Said compression springs 18 and 19 exert on sliding member 14 and thus to front member 3*b* a force acting towards the front end of the ski and tending to move sole holder 6 away from the automatic heel retaining mechanism 7. In order to prevent sole holder 6 from moving in the manner described with releasing plate 3 in its skiing position, ski 1 is provided with a stationary stop member 20 forming an abutment for plate member 3*b* and sole holder 6. This arrangement gives assurance that, with releasing plate 3 in its skiing position, the distance between sole holder 6 and the automatic heel retaining mechanism 7 remains constant. Should the releasing mechanism 10 be constructed, for example, as disclosed in Federal German Laid Open Specification No. 26 03 959, the releasing pin 11 which is formed as a longitudinally slidable ball head pin 11 may constitute an abutment for plate member 3*b*, it being possible in this case to omit the stationary stop member 20. In the case of the latter solution, it is possible for said releasing pin to retreat slightly in accordance with the characteristic of the releasing spring of releasing mechanism 10 as the releasing pin is subjected to a large thrust applied thereto by the ski boot via sole holder 6. Under certain circumstances it may be necessary in releasing mechanism 10 of this type to provide on the ski a stationary abutment co-operating with plate member 3*b*, said stop member being adapted to prevent plate member 3*b* from being urged backwardly towards the automatic heel retaining mechanisms 7 by the releasing pin of releasing mechanism 10.

Figure 2:
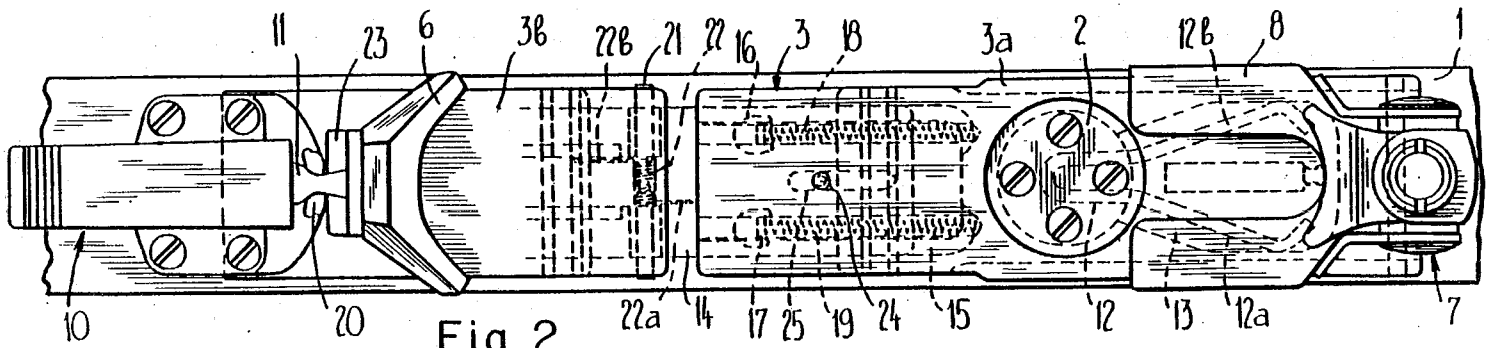
FIG. 2 is a plan view of the ski binding of FIG. 1.

The connection between front plate member 3*b* and sliding member 14 is constituted by a pivot axle 21 extending at right angles to the longitudinal axis of releasing plate 3 and parallel to the longitudinal axis of ski 1. As shown in FIG. 1, plate member 3*b* together with sole holder 6 is pivotable about pivot axle 21 in an upward direction, i.e. in the direction of arrow A. Pivot axle 21 extends through a coiled spring 22 comprising two radially extending legs 22*a* and 22*b*; leg 22*a* bears against the under side of sliding member 14, whereas leg 22*b* bears against the under side of plate member 3*b*. During a lateral release motion, coiled spring 22 will automatically raise plate member 3*b* in a manner yet to be described. It will be understood that it is possible to replace coiled spring 22 by other suitable spring elements. In order to prevent plate member 3*b* from being pivoted upwardly with releasing plate 3 in its skiing position under the influence of coiled spring 21, front plate member 3*b* is provided with an extension 23 which bears against releasing pin 11 of lateral release mechanism 10. Thus, lateral release mechanism 10 also serves the function of a locking device for plate member 3*b*, which locking device retains plate member 3*b* in its normal position.

The two plate members 3*a* and 3*b* are interconnected by means of a screw 24 screwed into rear plate member 3*a* and engaging in a longitudinal slot 25 of sliding member 14. Removing screw 24 will permit the two plate members 3*a* and 3*b* to be separated from one another. This arrangement permits easy replacement of front plate member 3*b* including sole holder 6. In this manner it is possible to employ always the same rear plate member 3*a* for ski boots of different sizes and to combine with plate member 3*a* a front plate member 3*b* selected to suit the size of a given ski boot. Moreover, it is possible in a facile manner to replace a worn front plate member 3*b* and sole holder 6.

Following is a description of the manner of operation of the inventive safety ski binding. As mentioned above, a frontal fall of the skier will cause automatic heel retaining mechanism 7 to be actuated in order to release the ski boot. Should the forces acting on releasing plate 3 and tending to pivot it be so small that no release is effected in a lateral direction, releasing plate 3 will be moved within the elastic range of damping within which releasing plate 3, upon the forces mentioned disappearing, is urged to return into its skiing position by releasing pin 11 of lateral releasing mechanism 10 and spring 12. This elastic damping range is limited to a range of pivoting of approximately 5° to either side. Upon this elastic range being exceeded during a torsional fall of the skier, releasing pin 11 will be disengaged from plate member 3*b*, this causing releasing plate 3 to be released for lateral pivoting. During such lateral pivoting, extension 23 will be disengaged from stop member 20 so that the two compression springs 18 and 19 will move front plate member 3*b* with sole holder 6 in a forward direction, i.e. away from automatic heel retaining mechanism 7. This increase in the distance between sole holder 6 and heel retaining mechanism 7 serves to release the ski boot. As soon as the ski boot has become detached from releasing plate 3 so that front plate member 3*b* has no longer to carry any load, front plate member 3*b* will be tilted upwardly about pivot axle 21 in the direction of arrow A by coiled spring 22 to such an extent that front plate member 3*b* assumes a position above lateral release mechanism 10. This arrangement ensures a reliable restoration of releasing plate 3 from its laterally pivoted position to its skiing position by means of spring 12. With releasing plate 3 now again being in its skiing position, the upwardly tilted plate member 3*b* may be restored into its normal position in a simple manner. This may be done by hand; for this purpose the two compression springs 18 and 19 are compressed and front plate member 3*b* is slid rearwardly and re-engaged with releasing pin 11. However, it is also possible to construct plate member 3*b* and/or releasing mechanism 10 in such a manner that the upwardly tilted plate member 3*b* can be restored to its normal position by applying a downwardly directed force by means of a hand or a foot of the skier.

Automatic restoration to its skiing position of releasing plate 3 after lateral pivoting is not only of importance for comfortable use of the binding but also for proper functioning of the ski brake. As mentioned above, the ski brake moves together with releasing plate 3 upon lateral pivoting thereof. However, with releasing plate 3 pivoted laterally, the ski brake cannot unexpectedly move into its braking position. Only after releasing plate 3 has been restored to its skiing position will it be possible for the two braking arms of the ski brake to assume their braking position. Thus reliable and immediate restoration of releasing plate 3 is of decisive importance for proper functioning of the ski brake.

As mentioned earlier, lateral releasing mechanism 10 will also respond to a rearward fall of the skier. In such a case, releasing pin 11 is pivoted upwardly, thus releasing front plate member 3*b* and sole holder 6 for upward tilting about axle 21. During this operation, front plate member 3*b* and sole holder 6 are moved forwardly by the two compression springs 18 and 19 in the same manner as during lateral release so as to ensure reliable release of the ski boot. In order to ensure immediate and reliable release of the ski boot during such a rearward fall it may be of advantage to provide a different arrangement permitting plate member 3*b* to be displaced longitudinally in relation to plate member 3*a*. It is possible, for example, to provide rear plate member 3*a* with an extension adapted slidably to guide front plate member 3*b* longitudinally of releasing plate 3. Thus this extension serves the function of a guide rail for plate member 3*b*. In this case, the compression springs 18 and 19 will have to be disposed between front plate member 3*b* and the rear plate member 3*a*, i.e. its extension.

It will be understood that certain component parts of the safety ski binding described above and shown in the drawings may be modified. For example, it is possible to omit the two compression springs 18 and 19. In this case, the movement of front plate member 3*b* in relation to rear plate member 3*a* is effected by the forces to which front plate member 3*b* with sole holder 6 is subjected during a fall. Instead of employing the spring element 22 serving to pivot front plate member 3*b* upwardly, it is possible to construct that part of front plate member 3*b* which bears against the under side of the ski boot sole as a flat spring which is elastically prestressed as long as front plate member 3*b* is in its normal position. Upon front plate member 3*b* being released by releasing mechanism 10, the inherent elasticity of plate member 3*b* will automatically cause upward pivoting of the forward portion of release plate member 3*b* carrying sole holder 6. It is, of course, also possible to reverse the arrangement of component parts in the safety ski binding described. In the latter case, front plate member 3*b* with sole holder 6 is adapted to be laterally pivoted about pivot pin 2 but not capable of being lifted off ski 1, whereas rear plate member 3*a* carrying heel retaining mechanism 7 is longitudinally slidably guided on front plate member 3*b* and adapted to be pivoted upwardly. In this case, release mechanism 10 would be adapted to engage, at a rearward position, the rear plate member 3*a* carrying heel retaining mechanism 7. Both the construction and manner of operation of this embodiment would correspond to those of the embodiment shown in FIGS. 1 and 2. In the case of a frontal fall, the release operation could be effected in a similar manner as described for a rearward fall in the case of the embodiment shown in other words, on a frontal fall the releasing mechanism would release the heel retaining mechanism to permit it to be pivoted upwardly, this resulting in the ski boot being detached from releasing plate 3.

The hinge (pivot axle 21) permitting part of releasing plate 3 to be pivoted upwardly enables the releasing plate substantially to follow any deflection of ski 1 when in use. Thus the aforedescribed ski binding, in contrast to conventional plate-type bindings, will not tend to increase the rigidity of the ski in the vicinity of the binding. In the same manner as with such known plate-type bindings, no relative motion between the ski boot sole and parts of the binding is possible during motion within the elastic range and also during the release action so that lateral release is possible completely independently of the condition of the ski boot sole. However, in contrast to these known bindings of the exclusive plate type, releasing plate 3 will remain connected with ski 1 and, upon release having been effected, will be automatically swung back into its normal position, it being understood additionally that reliable release of the ski boot is ensured. Therefore, the ski binding described is comparable with the conventional front-jaw-heel-retainer bindings.

What is claimed is:

1. A safety ski binding comprising a releasing plate mounted on an associated ski for lateral pivoting in opposite directions, said releasing plate being formed of components adjustably movable with respect to each other in the lateral direction of the ski, a lateral release mechanism for releasably retaining said releasing plate in its skiing position, ski boot sole retaining means and a heel retaining mechanism associated with said releasing plate for releasably holding a ski boot and for releasing the ski boot upon the skier falling forwardly, one of said retaining means and said retaining mechanism being adapted to be movable away from the other upon said releasing plate being pivoted upon release thereof in a lateral direction, and restoring means for restoring said releasing plate to its skiing position, the movable one of said ski boot sole retaining means and said heel retaining mechanism being upwardly pivotable from a normal position thereof upon a lateral release motion thereof.

2. The safety ski binding of claim 1, characterized in that upward pivoting of said movable one of said sole retaining means and said heel retaining mechanism being effected by spring force, particularly by spring force produced by at least one spring element.

3. The safety ski binding of claim 2, characterized in that said upward pivoting is an axle extending transversely of the longitudinal axis of the ski.

4. The safety ski binding of any of claims 1 to 3, characterized in that said upwardly pivotable retaining means is adapted to be held in its normal position by locking means which are preferably constituted by said lateral releasing means.

5. The safety ski binding of claim 4, characterized in that said upwardly pivotable retaining means are connected to a component part of said releasing plate, which component part is adapted to be slidably moved in the direction of the longitudinal axis of the ski in relation to a second component part of said releasing plate, which second component part is pivotally mounted on the ski and carries said other retaining means.

6. The safety ski binding of claim 5, characterized in that one of the two component parts of said releasing plate is provided with a sliding member which is slidably guided in a longitudinal direction in the other component part of said releasing plate.

7. The safety ski binding of claim 6, characterized in that said upwardly pivotable retaining means is engaged by at least one spring element adapted to act in the direction of the longitudinal axis of said releasing plate, said at least one spring element being adapted, with said releasing plate in its skiing position, to urge said upwardly pivotable retaining means against a stop member which is rigidly attached to the ski.

8. The safety ski binding of claim 6, characterized in that said component part of said releasing plate carrying said upwardly pivotable retaining means is detachably connected with the other component part of said releasing plate.

9. The safety ski binding of claim 8, characterized in that said restoring means comprise at least one spring element which is rigidly connected to the ski or to said releasing plate, said spring element being tensioned upon said releasing plate being pivoted.

10. The safety ski binding of claim 9, characterized in that said releasing plate is provided with a ski brake which is adapted to snap into its braking position upon the ski boot being detached from said releasing plate.

11. The safety ski binding of claim 10, characterized in that said heel retaining means is mounted on a slide member which carries said ski brake and which is connected to said releasing plate in such a manner as to be slidable in the direction of the longitudinal axis of the ski.

12. The safety ski binding of claim 11, characterized in that said upwardly pivotable retaining means in its normal position, with said releasing plate in its skiing position, co-operates with a stop member which is adapted to limit the distance through which said upwardly pivotable retaining means may be moved away from said other retaining means.

13. The safety ski binding of claim 12 characterized in that said stop member is constituted by said releasing element of said releasing mechanism, which releasing element is adapted to be displaced in the direction of the longitudinal axis of the ski against a spring force.

* * * * *